United States Patent [19]

Lin

[11] Patent Number: 5,044,998

[45] Date of Patent: Sep. 3, 1991

[54] SOCKET

[76] Inventor: Chao C. Lin, No. 2, Ching Cherng 4 St., Hsi Chu, Taichung, Taiwan

[21] Appl. No.: 599,862

[22] Filed: Oct. 19, 1990

[51] Int. Cl.[5] ..... H01R 13/00

[52] U.S. Cl. ..... 439/856; 439/850; 439/852

[58] Field of Search ..... 439/850, 852, 856, 858, 439/860, 862, 845, 828

[56] References Cited

U.S. PATENT DOCUMENTS 3,609,640 9/1971 Longenecker et al. ..... 439/852

4,699,444 10/1987 Isohata ..... 439/852

FOREIGN PATENT DOCUMENTS 0354127 8/1931 United Kingdom ..... 439/850

*Primary Examiner*—Paula A. Bradley

*Attorney, Agent, or Firm*—Sixbey, Friedman, Leedom & Ferguson

[57] ABSTRACT

A socket has two slots formed in an upper side of a casing and communicated with two chambers formed in the casing. A conductor is located in each of the chambers and includes a vertical member, a bent member parallel to the vertical member, and a resilient member disposed below the bent member. The middle portions of the prongs of a plug can be stably held between the vertical member and the bent member, and the lower portions of the prongs can be pressed by the resilient member and can be stably held in place by the resilient member.

2 Claims, 4 Drawing Sheets

SOCKET

BACKGROUND OF THE INVENTION

The present invention relates to a socket, and more particularly to a socket which can stably hold a plug plugged therein.

A socket is disclosed in U.S. Pat. No. 4,892,542 to Wang. The socket includes two protuberance sets provided in each side of the socket. A plug which is plugged into the socket is clamped and retained in place by the spring biased balls of the protuberance sets. The contact surfaces among the prongs of the plug and the balls of the protuberance sets are point contacts and are very small so that the prongs of the plug can not be stably held in place and so that the electric conductivity is bad.

The present invention has arisen to mitigate and/or obviate the afore-described disadvantages of the conventional sockets.

SUMMARY OF THE INVENTION

The primary objective of the present invention is to provide a socket which can stably hold the prongs of the plug in place.

In accordance with one aspect of the invention, there is provided a socket which comprises a casing. Two slots are formed in an upper side of the casing and are respectively communicated with two chambers which are formed in the casing. A conductor is located in each of the chambers, each conductor includes a first member vertically disposed below the slot, a second member parallel to the first member, and a third member. The second member is resilient and is straight and parallel to the first member so that the first member and the second member form a receptacle for receiving a prong of a plug. The third member is disposed below the second member and is resilient. When the prongs are inserted through the slots into the socket, a middle portion of each of the prongs is stably held between the first member and the second member by a resilient force of the second member, and a lower end of the prong is pressed by the third member and is stably held in place by a resilient force of the third member.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
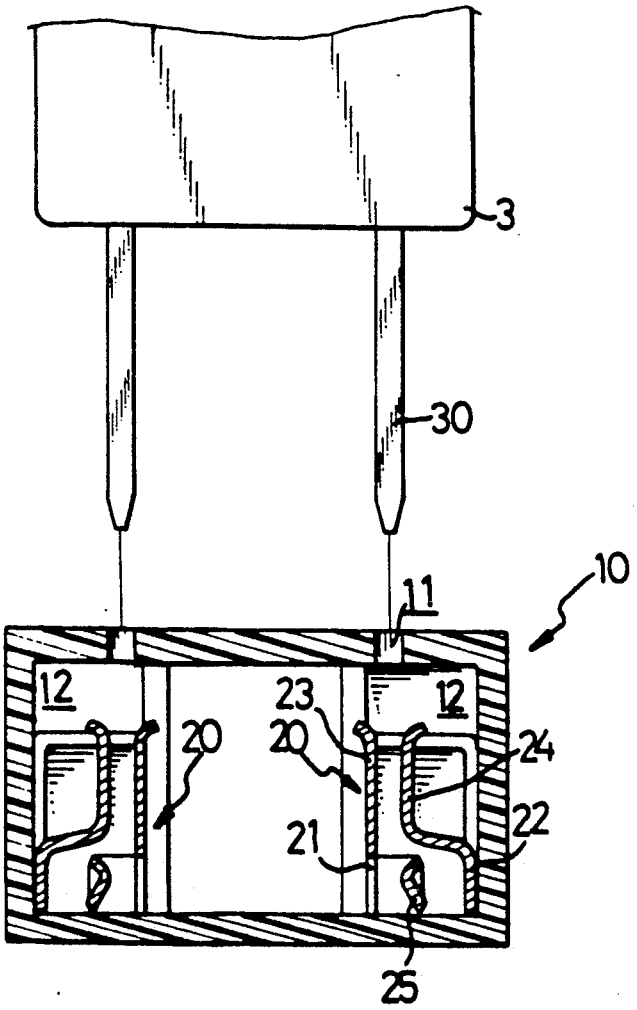
FIG. 1 is a cross sectional view of a socket in accordance with the present invention.
Figure 2:
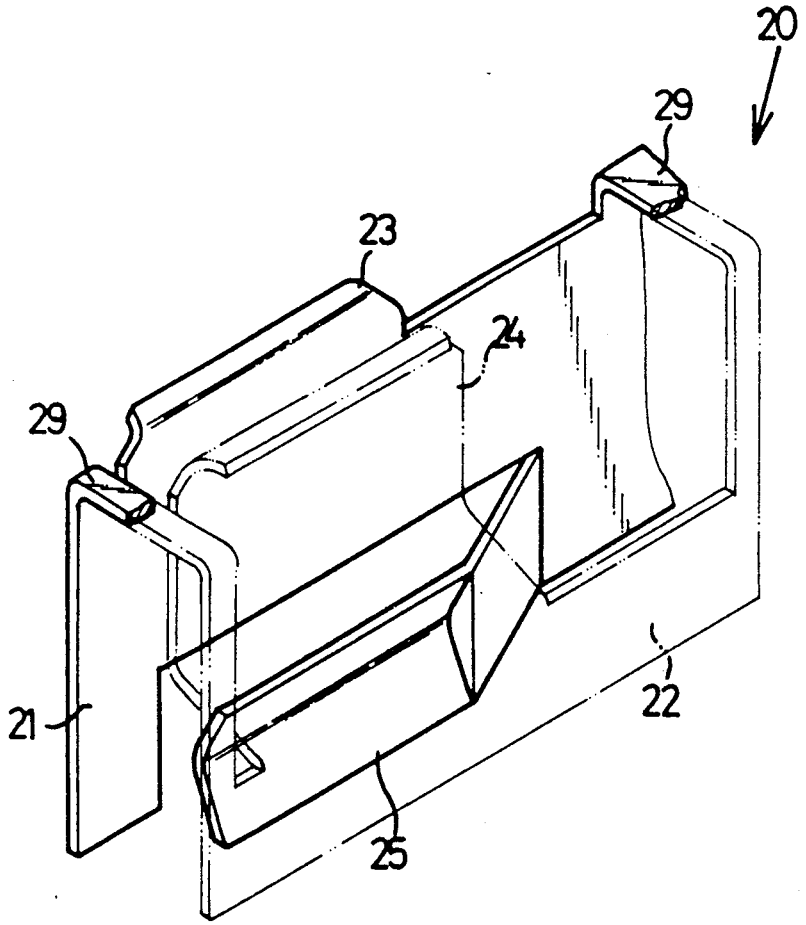
FIG. 2 is a partial perspective view of the socket, illustrating a lower portion of the socket.

Referring to the drawings and initially to FIGS. 1 and 2, a socket in accordance with the present invention comprises generally a casing 10. Two slots 11 are formed in the upper side of the casing 10 and are respectively communicated with two chambers 12 which are formed in the casing 10. A conductor 20 which is preferably made of copper is located in each of the chambers 12.

Each conductor 20 includes generally a first plate 21 and a second plate 22 which are substantially parallel with each other and which are vertically disposed in each of the chambers 12. The two plates 21, 22 are integrally connected together by several cross girders 29. A first member 23 which is formed by the first plate 21 is located below the slot 11. A second member 24 is bent from the second plate 22 so that the second member 24 is resilient. The second member 24 is substantially straight and is parallel to the first member 23 so that the second member 24 and the first member 23 form a receptacle for receiving the prongs 30 of a plug 3. The upper ends of the first member 23 and the second member 24 are preferably curved outward so that the prongs 30 can be easily inserted into the socket. A third member 25 which is punched from the first plate 21 and which is substantially S-shaped has one end integrally connected to the first plate 21 so that the third member 25 is resilient. The third member 25 is disposed below the second member 24.

Figure 3:
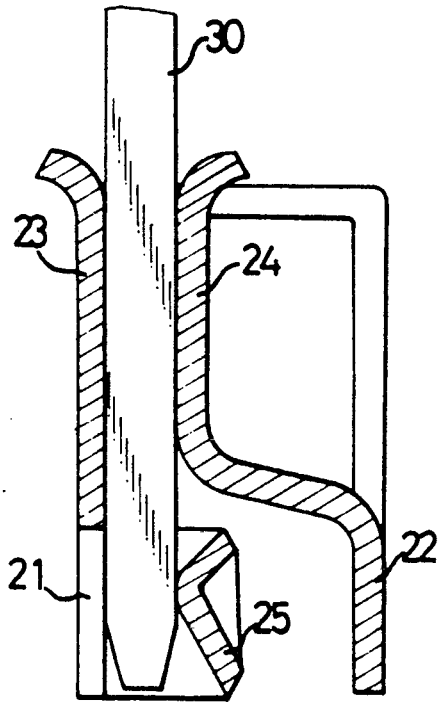
FIG. 3 is a partial cross sectional view of the socket, in which a prong of a plug is inserted into one of the conductors.

Referring next to FIG. 3, when the prongs 30 are inserted through the slots 11 into the socket, the middle portion of each of the prongs 30 is stably held between the first member 23 and the second member 24 by a resilient force of the second member 24, and the lower end of the prong 30 is pressed by the third member 25 and is stably held in place by a resilient force of the third member 25. The contact surfaces among the prongs 30 of the plug 3 and the first member and the second member 23, 24 are very large so that the conductivity of the socket is increased. The lower ends of the prongs 30 are pressed by the third member 25 so that the prongs 30 can be stably held in place.

Figure 4:
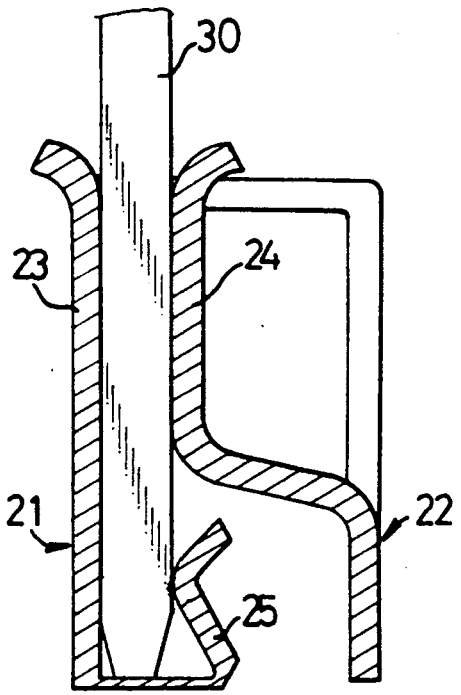
FIG. 4 is a partial cross sectional view similar to FIG. 3, illustrating another embodiment of the present invention.

Referring next to FIG. 4, illustrated is another embodiment in accordance with the present invention. In this embodiment, the third member 25 which is also substantially S-shaped is also bent from the first plate 21, but the lower portion of the third member 25 is integrally coupled to the first plate 21 so that the third member 25 is also resilient. The third member 25 can also press the lower end portion of each of the prongs 30 when the prongs 30 are inserted into the socket so that the prongs 30 can be stably held in place.

Accordingly, the socket in accordance with the present invention can stably hold the prongs 30 of the plug 3 which is plugged into the socket.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A socket comprising generally a casing, two slots being formed in an upper side of said casing and being respectively communicated with two chambers which are formed in said casing, and a conductor being located in each of said chambers; each of said conductors including a first member vertically disposed below said slot, a second member which is resilient being parallel to said first member so that said first member and said second member form a receptacle for receiving a prong of a plug, an upper end of said first member and an upper end of said second member being curved outward so as to facilitate an insertion of said prongs into said socket, and a third member being disposed below said second member and being resilient; each of said conductors including substantially a first plate and a second plate which are substantially parallel with each other and which are vertically disposed in each of the chambers, said first member being formed by said first plate, said second member being bent from said second plate, said third member being punched from said first plate and having one end integrally coupled to said first plate so that said third member is resilient; and when said prongs are inserted through said slots into said socket, a middle portion of each of said prongs being stably held between said first member and said second member by a resilient force of said second member, and a lower end of said prong being pressed by said third member and being stably held in place by a resilient force of said third member.

2. A socket comprising generally a casing, two slots being formed in an upper side of said casing and being respectively communicated with two chambers which are formed in said casing, and a conductor being located in each of said chambers; each of said conductors including a first member vertically disposed below said slot, a second member which is resilient being parallel to said first member so that said first member and said second member form a receptacle for receiving a prong of a plug, an upper end of said first member and an upper end of said second member being curved outward so as to facilitate an insertion of said prongs into said socket, and a third member being disposed below said second member and being resilient; each of said conductors including substantially a first plate and a second plate which are substantially parallel with each other and which are vertically disposed in each of the chambers, said first member being formed by said first plate, said second member being bent from said second plate, said third member being bent from said first plate and having a bottom portion integrally coupled to said first plate so that said third member is resilient; and when said prongs are inserted through said slots into said socket, a middle portion of each of said prongs being stably held between said first member and said second member by a resilient force of said second member, and a lower end of said prong being pressed by said third member and being stably held in place by a resilient force of said third member.

* * * * *